US010707613B2

(12) United States Patent
Du et al.

(10) Patent No.: US 10,707,613 B2
(45) Date of Patent: Jul. 7, 2020

(54) FOLDABLE POWER PLUG ASSEMBLY

(71) Applicant: Dell Products L.P., Round Rock, TX (US)

(72) Inventors: Hang Du, Singapore (SG); Tiong Chee Benedict Tay, Singapore (SG); Yu Weng Alvin Sitoh, Singapore (SG); Toshiyuki Tanaka, Tokyo (JP)

(73) Assignee: Dell Products L.P., Round Rock, TX (US)

( * ) Notice: Subject to any disclaimer, the term of this patent is extended or adjusted under 35 U.S.C. 154(b) by 103 days.

(21) Appl. No.: 16/146,061

(22) Filed: Sep. 28, 2018

(65) Prior Publication Data

US 2020/0106214 A1 Apr. 2, 2020

(51) Int. Cl.
*H01R 13/629* (2006.01)
*H01R 24/66* (2011.01)

(52) U.S. Cl.
CPC ..... *H01R 13/62933* (2013.01); *H01R 24/66* (2013.01)

(58) Field of Classification Search
CPC ..... H01R 13/62933; H01R 24/66
See application file for complete search history.

(56) References Cited

U.S. PATENT DOCUMENTS 5,611,701 A * 3/1997 Hahn ..... H01R 24/66 439/131
9,077,093 B1 * 7/2015 Roy ..... H02K 49/10
9,166,351 B1 * 10/2015 Wang ..... H01R 27/00
9,331,441 B2 * 5/2016 Roy ..... H01R 24/68
2012/0169272 A1 * 7/2012 Khalepari ..... H01R 31/065 320/107
2015/0364882 A1 * 12/2015 Roy ..... H01R 13/434 439/131

OTHER PUBLICATIONS

Apple. Apple 5W USB Power Adapter (Folding Pins). Retrieved from https://www.apple.com/uk/shop/product/MGRL2B/A/apple-5w-usb-power-adapter-folding-pins (2018); 2 pages.
Made in Mind. Mu UK Charger. Retrieved from http://www.madeinmind.co.uk/current-mu-products/ (2017); 4 pages.

* cited by examiner

*Primary Examiner* — Abdullah A Riyami
*Assistant Examiner* — Nader J Alhawamdeh
(74) *Attorney, Agent, or Firm* — Baker Botts L.L.P.

(57) ABSTRACT

A foldable power plug assembly may include a lever-based mechanism for retracting the metal pins of the assembly such that they do not extend beyond a top surface of a base portion of the assembly and for subsequently extracting the pins from the base portion. When a force is applied to a first pin in a folding direction while the assembly is in a deployed state, the lever-based mechanism may be configured to retract both the first and second pins toward their respective fully retracted positions. When a force is applied to the first pin in an unfolding direction while the assembly is in a retracted state, the mechanism may be configured to unfold both the first and second pins toward their respective fully deployed positions. and extend them to their fully deployed positions. The lever-based mechanism may be simple and intuitive to operate using a single hand.

20 Claims, 8 Drawing Sheets

FOLDABLE POWER PLUG ASSEMBLY

BACKGROUND

Field of the Disclosure

This disclosure relates generally to information handling systems and, more particularly, to a foldable power plug assembly through which a power adapter or power cable coupled to an information handling system is connected to an alternating current (AC) power source.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems typically include a power cable having a power plug of a particular type that is dependent on the region in which the system was intended to be sold or used. Some types of power plugs include two pins, while others include three pins. Many of the three-pin power plugs are large and awkwardly shaped, making the power cables difficult to store efficiently when transporting them. In some cases, the exposed pins of the largest power plugs can scratch other components of the system, such as a smooth metal housing or fragile display screen, causing damage.

SUMMARY

In one aspect, a disclosed information handling system includes a power supply unit, a power cable coupled to the power supply unit through a connector at a first end of the power cable, and a foldable power plug assembly coupled to a second end of the power cable to connect the power cable to an alternating current (AC) power source. The foldable power plug assembly includes a base housing portion, a first pin including a first post proximate a bottom end of the first pin, a second pin including a second post proximate a bottom end of the second pin, and a first lever disposed within the base housing portion. The first lever includes a first slot into which the first post is inserted and along which the first post is slidable, and a second slot into which the second post is inserted and along which the second post is slidable. When the foldable power plug assembly is in a fully deployed state, the first post is positioned at a first end of the first slot, the first end of the first slot being nearer a pivot point of the first lever than a second end of the first slot, the second post is positioned at a first end of the second slot, the first end of the second slot being farther from the pivot point of the first lever than a second end of the second slot, the first pin is positioned in a fully deployed position for the first pin in which the first pin extends through a first opening in a top surface of the base housing portion in a direction substantially perpendicular to the top surface, and the second pin is positioned in a fully deployed position for the second pin in which the second pin extends through a second opening in the top surface of the base housing portion in a direction substantially perpendicular to the top surface. When the foldable power plug assembly is in a fully retracted state, the first post is positioned at the second end of the first slot, the second post is positioned at the second end of the second slot, the first pin is retracted into a fully retracted position for the first pin in the base housing portion in which the first pin is substantially parallel to the top surface and no part of the first pin extends through the first opening in the top surface, and the second pin is retracted into a fully retracted position for the second pin in the base housing portion in which the second pin is substantially perpendicular to the top surface and no part of the second pin extends through the second opening in the top surface.

In any of the disclosed embodiments, the first pin may be a ground pin and the second pin may be a power pin.

In any of the disclosed embodiments, the foldable power plug assembly may further include a third pin including a third post proximate a bottom end of the third pin, and a second lever disposed within the base housing portion, the second lever including a third slot into which the third post of the third pin is inserted and along which the third post is slidable, and a fourth slot into which a fourth post of the first pin is inserted and along which the fourth post is slidable. When the foldable power plug assembly is in the fully deployed state, the fourth post may be positioned at a first end of the fourth slot, the first end of the fourth slot being nearer a pivot point of the second lever than a second end of the fourth slot, the third post may be positioned at a first end of the third slot, the first end of the third slot being farther from the pivot point of the second lever than a second end of the third slot, and the third pin may be positioned in a fully deployed position for the third pin in which the third pin extends through a third opening in the top surface of the base housing portion in a direction substantially perpendicular to the top surface. When the foldable power plug assembly is in the fully retracted state, the third post may be positioned at the second end of the third slot, the fourth post may be positioned at the second end of the fourth slot, and the third pin may be retracted into a fully retracted position for the third pin in the base housing portion in which the third pin is substantially perpendicular to the top surface and no part of the third pin extends through the third opening in the top surface.

In any of the disclosed embodiments, the second pin may be positioned on a first side of the first opening and the third pin may be positioned on a second side of the first opening opposite the first side. The second pin and the third pin may be equidistant from the first pin and are symmetric about the first opening.

In any of the disclosed embodiments, the foldable power plug assembly may further include a third pin including a third post proximate a bottom end of the third pin, the third post coupled to the second post in a fixed position with respect to the second post. When the foldable power plug assembly is in the fully deployed state, the third post may be positioned proximate the first end of the first slot, and the third pin may be positioned in a fully deployed position for the third pin in which the third pin extends through a third opening in the top surface of the base housing portion in a direction substantially perpendicular to the top surface. When the foldable power plug assembly is in a fully retracted state, the third post may be positioned proximate the second end of the first slot, and the third pin may be retracted into a fully retracted position for the third pin in the base housing portion in which the third pin is substantially perpendicular to the top surface and no part of the third pin extends through the third opening in the top surface.

In any of the disclosed embodiments, when the foldable power plug assembly is in the fully deployed state, the first post may be positioned at a depth below the top surface greater than the depth at which the second post is positioned, and the pivot point of the first lever may be positioned at a depth below the top surface between the depth at which the first post is positioned and the depth at which the second post is positioned.

In any of the disclosed embodiments, when the foldable power plug assembly is in a partially deployed state, the first post may be positioned between the first end of the first slot and the second end of the first slot, the second post may be positioned between the first end of the second slot and the second end of the second slot, the first pin may be positioned in a partially deployed position for the first pin in which the first pin extends through the first opening in the top surface of the base housing portion at an angle with respect to the top surface of less than ninety degrees, and the second pin may be positioned in a partially deployed position for the second pin in which a smaller portion of the second pin extends through the second opening in the top surface of the base housing portion in a direction substantially perpendicular to the top surface than the portion of the second pin that extends through the second opening when the foldable power plug assembly is in the fully deployed state.

In any of the disclosed embodiments, responsive to a force applied to the first pin in a folding direction for the first pin while the foldable power plug assembly is in the fully deployed state or in a partially deployed state, the foldable power plug assembly may be configured to retract the second pin toward the fully retracted position for the second pin, and responsive to a force applied to the first pin in an unfolding direction for the first pin while the foldable power plug assembly is in the fully retracted state or in a partially deployed state, the foldable power plug assembly may be configured to extend the second pin toward the fully deployed position for the second pin.

In any of the disclosed embodiments, to retract the second pin toward the fully retracted position for the second pin, the first lever may be configured to convert a rotational movement of the first pin in response to the force applied to the first pin in the folding direction into a downward linear force on the second post, and to extend the second pin toward the fully deployed position for the second pin, the first lever may be configured to convert a rotational movement of the first pin in response to the force applied to the first pin in the unfolding direction into an upward linear force on the second post.

In any of the disclosed embodiments, the first opening may be parallel to the first lever and extends from one edge of the top surface to an interior point on the top surface.

In another aspect, a disclosed foldable power plug assembly includes a base housing portion, a first pin including a first post proximate a bottom end of the first pin, a second pin including a second post proximate a bottom end of the second pin, and a first lever disposed within the base housing portion. The first lever includes a first slot into which the first post is inserted and along which the first post is slidable, and a second slot into which the second post is inserted and along which the second post is slidable. When the foldable power plug assembly is in a fully deployed state, the first post is positioned at a first end of the first slot, the first end of the first slot being nearer a pivot point of the first lever than a second end of the first slot, the second post is positioned at a first end of the second slot, the first end of the second slot being farther from the pivot point of the first lever than a second end of the second slot, the first pin is positioned in a fully deployed position for the first pin in which the first pin extends through a first opening in a top surface of the base housing portion in a direction substantially perpendicular to the top surface, and the second pin is positioned in a fully deployed position for the second pin in which the second pin extends through a second opening in the top surface of the base housing portion in a direction substantially perpendicular to the top surface. When the foldable power plug assembly is in a fully retracted state, the first post is positioned at the second end of the first slot, the second post is positioned at the second end of the second slot, the first pin is retracted into a fully retracted position for the first pin in the base housing portion in which the first pin is substantially parallel to the top surface and no part of the first pin extends through the first opening in the top surface, and the second pin is retracted into a fully retracted position for the second pin in the base housing portion in which the second pin is substantially perpendicular to the top surface and no part of the second pin extends through the second opening in the top surface.

In any of the disclosed embodiments, the first pin may be a ground pin and the second pin may be a power pin.

In any of the disclosed embodiments, the foldable power plug assembly may further include a third pin including a third post proximate a bottom end of the third pin, and a second lever disposed within the base housing portion, the second lever including a third slot into which the third post of the third pin is inserted and along which the third post is slidable, and a fourth slot into which a fourth post of the first pin is inserted and along which the fourth post is slidable. When the foldable power plug assembly is in the fully deployed state, the fourth post may be positioned at a first end of the fourth slot, the first end of the fourth slot being nearer a pivot point of the second lever than a second end of the fourth slot, the third post may be positioned at a first end of the third slot, the first end of the third slot being farther from the pivot point of the second lever than a second end of the third slot, and the third pin may be positioned in a fully deployed position for the third pin in which the third pin extends through a third opening in the top surface of the base housing portion in a direction substantially perpendicular to the top surface. When the foldable power plug assembly is in the fully retracted state, the third post may be positioned at the second end of the third slot, the fourth post may be positioned at the second end of the fourth slot, and the third pin may be retracted into a fully retracted position for the third pin in the base housing portion in which the third pin is substantially perpendicular to the top surface and no part of the third pin extends through the third opening in the top surface.

In any of the disclosed embodiments, the second pin may be positioned on a first side of the first opening and the third pin may be positioned on a second side of the first opening opposite the first side. The second pin and the third pin may be equidistant from the first pin and are symmetric about the first opening.

In any of the disclosed embodiments, the foldable power plug assembly may further include a third pin including a third post proximate a bottom end of the third pin, the third post coupled to the second post in a fixed position with respect to the second post. When the foldable power plug assembly is in the fully deployed state, the third post may be positioned proximate the first end of the first slot, and the third pin may be positioned in a fully deployed position for the third pin in which the third pin extends through a third opening in the top surface of the base housing portion in a direction substantially perpendicular to the top surface. When the foldable power plug assembly is in a fully retracted state, the third post may be positioned proximate the second end of the first slot, and the third pin may be retracted into a fully retracted position for the third pin in the base housing portion in which the third pin is substantially perpendicular to the top surface and no part of the third pin extends through the third opening in the top surface.

In any of the disclosed embodiments, when the foldable power plug assembly is in the fully deployed state, the first post may be positioned at a depth below the top surface greater than the depth at which the second post is positioned, and the pivot point of the first lever may be positioned at a depth below the top surface between the depth at which the first post is positioned and the depth at which the second post is positioned.

In any of the disclosed embodiments, when the foldable power plug assembly is in a partially deployed state, the first post may be positioned between the first end of the first slot and the second end of the first slot, the second post may be positioned between the first end of the second slot and the second end of the second slot, the first pin may be positioned in a partially deployed position for the first pin in which the first pin extends through the first opening in the top surface of the base housing portion at an angle with respect to the top surface of less than ninety degrees, and the second pin may be positioned in a partially deployed position for the second pin in which a smaller portion of the second pin extends through the second opening in the top surface of the base housing portion in a direction substantially perpendicular to the top surface than the portion of the second pin that extends through the second opening when the foldable power plug assembly is in the fully deployed state.

In any of the disclosed embodiments, responsive to a force applied to the first pin in a folding direction for the first pin while the foldable power plug assembly is in the fully deployed state or in a partially deployed state, the foldable power plug assembly may be configured to retract the second pin toward the fully retracted position for the second pin, and responsive to a force applied to the first pin in an unfolding direction for the first pin while the foldable power plug assembly is in the fully retracted state or in a partially deployed state, the foldable power plug assembly may be configured to extend the second pin toward the fully deployed position for the second pin.

In any of the disclosed embodiments, to retract the second pin toward the fully retracted position for the second pin, the first lever may be configured to convert a rotational movement of the first pin in response to the force applied to the first pin in the folding direction into a downward linear force on the second post, and to extend the second pin toward the fully deployed position for the second pin, the first lever may be configured to convert a rotational movement of the first pin in response to the force applied to the first pin in the unfolding direction into an upward linear force on the second post.

In any of the disclosed embodiments, the first opening may be parallel to the first lever and extends from one edge of the top surface to an interior point on the top surface.

BRIEF DESCRIPTION OF THE DRAWINGS

For a more complete understanding of the present invention and its features and advantages, reference is now made to the following description, taken in conjunction with the accompanying drawings, in which.

DESCRIPTION OF PARTICULAR EMBODIMENT(S)

Figure 1:
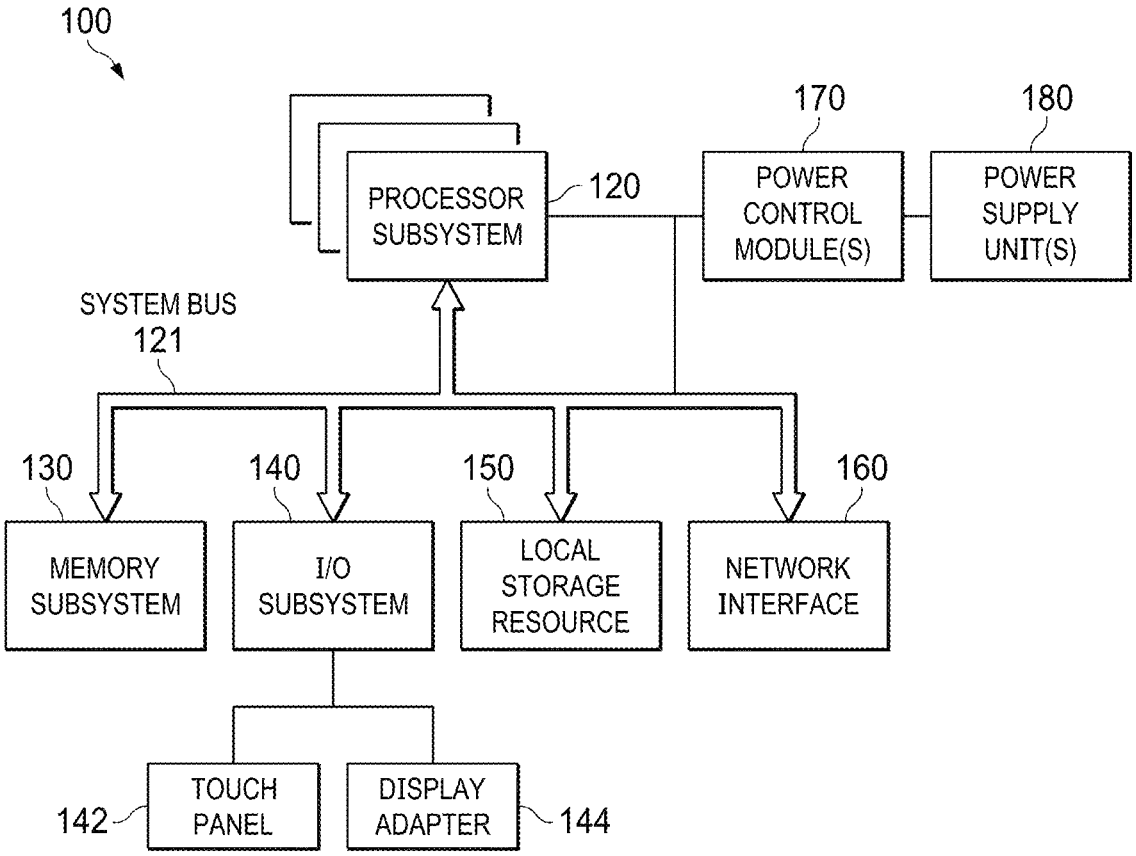
FIG. 1 is a block diagram of selected elements of an embodiment of an information handling system.

In the following description, details are set forth by way of example to facilitate discussion of the disclosed subject matter. It should be apparent to a person of ordinary skill in the field, however, that the disclosed embodiments are exemplary and not exhaustive of all possible embodiments.

As used herein, a hyphenated form of a reference numeral refers to a specific instance of an element and the unhyphenated form of the reference numeral refers to the collective or generic element. Thus, for example, widget "72-1" refers to an instance of a widget class, which may be referred to collectively as widgets "72" and any one of which may be referred to generically as a widget "72".

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components or the information handling system may include one or more power supplies, one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include an instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory (SSD); as well as communications media such wires, optical fibers, microwaves, radio waves, and other electromagnetic and/or optical carriers; and/or any combination of the foregoing.

As will be described in further detail, the inventors of the present disclosure have developed a foldable power plug assembly for information handling systems. The foldable power plug assembly may include a lever-based mechanism for fully retracting the pins of the foldable power plug assembly into the base portion of the assembly such that they do not extend beyond a top surface of the base portion. The lever-based mechanism may subsequently be used to extract the pins of the foldable power plug from the base portion and extend them to their fully deployed positions. The mechanism for folding and unfolding the foldable power plug assembly may be simple and intuitive to operate using only one hand.

Particular embodiments are best understood by reference to FIGS. 1, 2, 3, 4, 5A-5C, 6, 7, 8, and 9, in which like numbers are used to indicate like and corresponding parts.

Turning now to the drawings, FIG. 1 illustrates a block diagram depicting selected elements of an embodiment of information handling system 100. As described herein, information handling system 100 may represent a personal computing device, such as a personal computer system, a desktop computer, a laptop computer, a notebook computer, etc., operated by a user. In various embodiments, information handling system 100 may be operated by the user using a keyboard and a mouse (not shown).

As shown in FIG. 1, components of information handling system 100 may include, but are not limited to, processor subsystem 120, which may comprise one or more processors, and system bus 121 that communicatively couples various system components to processor subsystem 120 including, for example, a memory subsystem 130, an I/O subsystem 140, local storage resource 150, and a network interface 160. System bus 121 may represent a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

In FIG. 1, network interface 160 may be a suitable system, apparatus, or device operable to serve as an interface between information handling system 100 and a network (not shown). Network interface 160 may enable information handling system 100 to communicate over the network using a suitable transmission protocol and/or standard, including, but not limited to, transmission protocols and/or standards enumerated below with respect to the discussion of network 155. In some embodiments, network interface 160 may be communicatively coupled via the network to a network storage resource (not shown). The network coupled to network interface 160 may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data). The network coupled to network interface 160 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. The network coupled to network interface 160 and/or various components associated therewith may be implemented using hardware, software, or any combination thereof.

As depicted in FIG. 1, processor subsystem 120 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor subsystem 120 may interpret and/or execute program instructions and/or process data stored locally (e.g., in memory subsystem 130). In the same or alternative embodiments, processor subsystem 120 may interpret and/or execute program instructions and/or process data stored remotely (e.g., in a network storage resource, not shown).

Also in FIG. 1, memory subsystem 130 may comprise a system, device, or apparatus operable to retain and/or retrieve program instructions and/or data for a period of time (e.g., computer-readable media). Memory subsystem 130 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as system 100, is powered down. Local storage resource 150 may comprise computer-readable media (e.g., hard disk drive, floppy disk drive, CD-ROM, and/or other type of rotating storage media, flash memory, EEPROM, and/or another type of solid state storage media) and may be generally operable to store instructions and/or data. In system 100, I/O subsystem 140 may comprise a system, device, or apparatus generally operable to receive and/or transmit data to/from/within information handling system 100. I/O subsystem 140 may represent, for example, a variety of communication interfaces, graphics interfaces, video interfaces, user input interfaces, and/or peripheral interfaces. As shown, I/O subsystem 140 may comprise touch panel 142 and display adapter 144. Touch panel 142 may include circuitry for enabling touch functionality in conjunction with a display device that is driven by display adapter 144. It is noted that when information handling system 100 is a laptop computer with an integrated display device, display adapter 144 may provide connectivity for an external display.

As illustrated in FIG. 1, system 100 may include one or more power control modules 170 and one or more power supply units (PSUs) 180. In at least some embodiments, power control modules 170 may include power distribution circuitry. In at least some embodiments, power control module(s) 170 may control the allocation of power generated by one or more of the power supply units (PSUs) 180 to other resources in system 100. In some embodiments, one or more of the power control modules 170 may include a management controller (MC). In some embodiments, the management controller may include circuitry and/or logic to determine the operating capability of the PSUs 180 based on environmental or other factors. In some embodiments, the PSUs 180 may be coupled to an AC power source through a power adapter or power cable that includes a connector to information handling system 100 on one end and a power plug designed to a particular power plug standard on the other end. Examples of two-pin power plug standards include, but are not limited to, Type-A (used in Mexico, the United States, Canada and Japan), Type-C (used in Europe, South America, and South Asia), Type-E (used in France, Belgium, Poland, Slovakia, and the Czech Republic), and Type-F (used in Russia and parts of Europe). Examples of three-pin power plug standards include, but are not limited to, including Type-B (used in Mexico, the United States, Canada, and Japan), Type-I (used in Australia, New Zealand, Argentina, and China), Type-D (used in India), Type-K (used in Denmark and Greenland), Type-F (used in South Africa), Type-G (used in the United Kingdom, Ireland, Malta, Malaysia, and Singapore), and Type-O (used in Thailand). These three-pin power plugs of these types are among the biggest and bulkiest used worldwide. Other three-pin power plug standards include Type-H (used in Israel, the West Bank, and the Gaza Strip), and Type-J (used in Switzerland, Rwanda, and Liechtenstein), which are not as large.

Given the large size and awkward shapes of some power plugs, including those adhering to various ones of the three-pin power plug standards described above, in can be difficult or inconvenient to pack power adapters or power cables that include these power plugs when traveling or even for the everyday transporting of an information handling system from home to office or between meetings. For example, when traveling to one or more different regions of the world, a traveler might need to carry different power adapters and/or power cables for each region having power plugs of a respective different types. In some cases, when one of these power accessories is placed in the same carrying case with a portable computer and/or a mobile device, it may take up an inordinate amount of space due to the size of the power plug or the exposed pins of the power plug may scratch the portable computer or a mobile device, causing damage.

However, in at least some embodiments of the present disclosure, an information handling system may include a power cable or power adapter with a foldable power plug assembly. In some embodiments, the foldable power plug assemblies described herein may allow users to quickly and easily fold the metal pins of a three-pin power plug into a compact, sleek base portion of the plug assembly with no portion of the pins extending beyond the surface of the base portion and, subsequently, to quickly and easily unfold the pins for deployment of the power plug. Because these foldable power plug assemblies are more compact than fixed power plugs of the same types and do not have extruded or exposed metal pins, they may be transported more safely and conveniently than their counterparts having fixed power plug pins.

Figure 2:
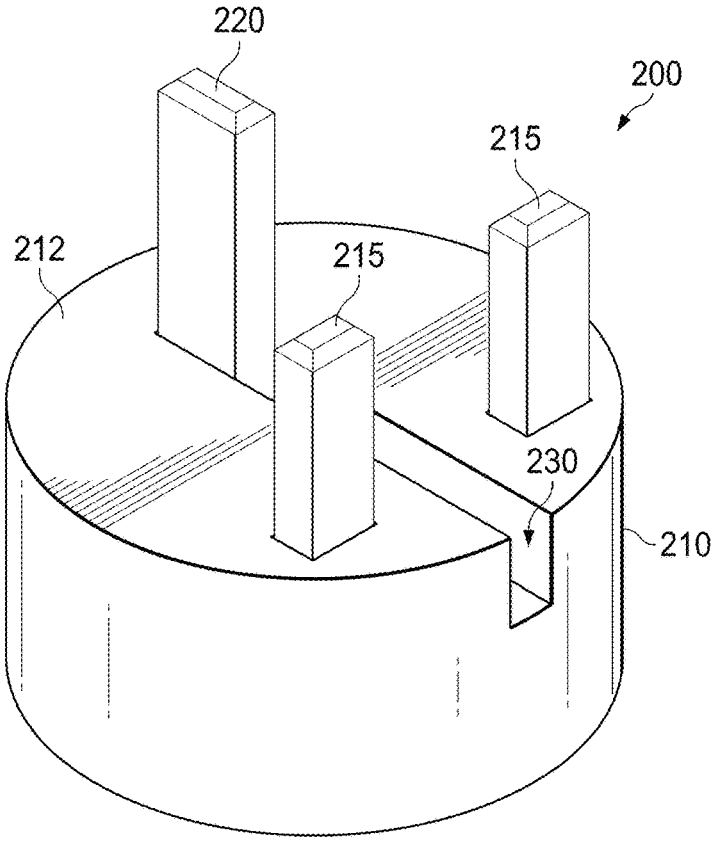
FIG. 2 illustrates a perspective view of selected elements of a foldable power plug assembly in a fully deployed state, according to at least some embodiments.

FIG. 2 illustrates a perspective view of selected elements of a foldable power plug assembly 200 in a fully deployed state, according to at least some embodiments. In the illustrated example, foldable power plug assembly 200 may, when in this fully deployed state, may adhere to the Type-G power plug standard. As shown in FIG. 2, foldable power plug assembly 200 includes a base portion 210 (e.g., a base housing portion of the foldable power plus assembly) whose top surface 212 includes first opening 230. In the illustrated example, opening 230 extends from one edge of top surface 212 to an interior point on top surface 212 and encompasses an opening on the side of base portion 210 at the intersection of top surface 212 and the side of base portion 210. A first power plug pin, shown as ground pin 220, extends through the first opening 230 to its fully deployed position. Two other power plug pins, shown as power pins 215, extend through respective smaller openings in top surface 212 to their fully deployed positions.

In at least some embodiments, foldable power plug assembly 200 may include a lever-based mechanism for fully retracting the power plug pins (e.g., ground pin 220 and both power pins 215) into the base portion 210 of assembly 200 such that they do not extend beyond top surface 212. The lever-based mechanism may subsequently be used to extract the power plug pins from the base portion 210 and extending them to their fully deployed positions.

Figure 3:
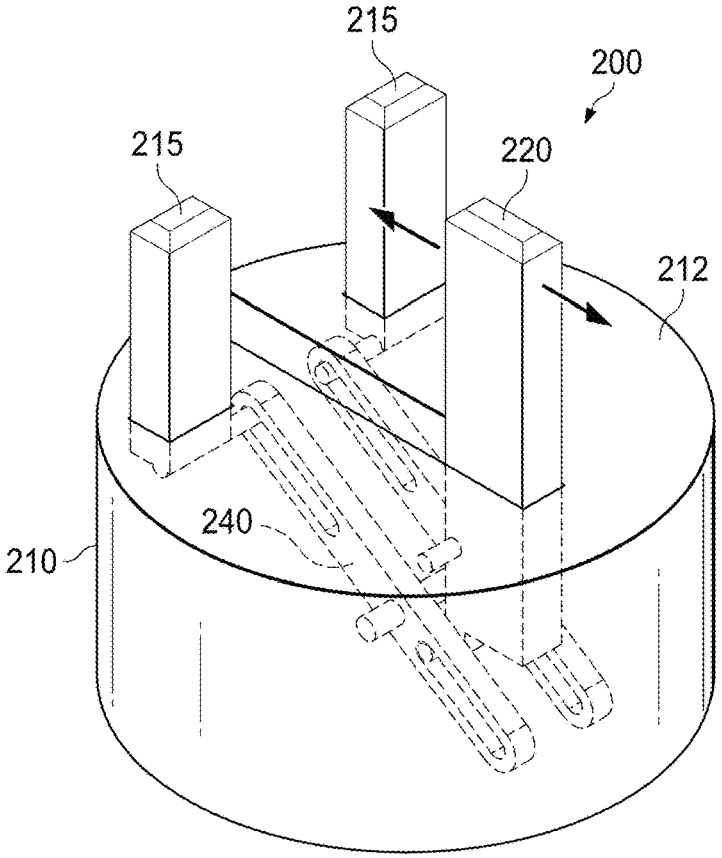
FIG. 3 illustrates a perspective view of a foldable power plug assembly in a fully deployed state including selected internal elements, according to at least some embodiments.

FIG. 3 illustrates a perspective view of foldable power plug assembly 200 in a fully deployed state including selected internal elements, according to at least some embodiments. In the illustrated example, foldable power plug assembly 200 includes two levers 240, each of which is coupled to a respective one of the power pins 215 and to a respective side of ground pin 220. More specifically, ground pin 220 is connected to each of the power pins 215 via a respective lever 240 having two separate slots. The operation of the lever-based mechanism is described in more detail below with reference to FIGS. 4 through 9. As shown in FIG. 3, the lever-based mechanism, including two levers 240, is disposed within the base portion of foldable power plug assembly 200 below the top surface 212 and is thus not visible when foldable power plug assembly 200 is installed and/or in use.

Figure 4:
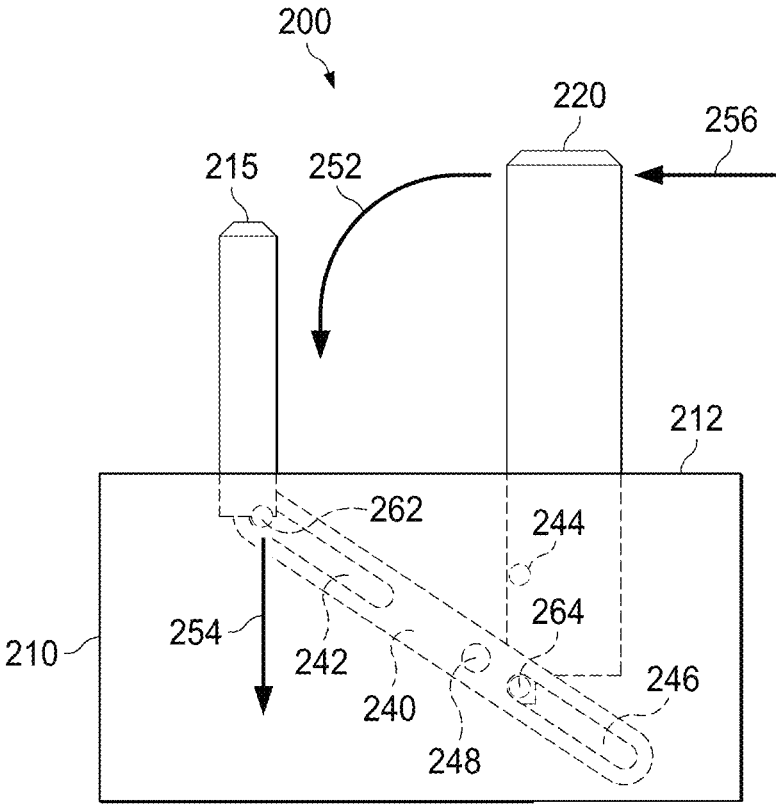
FIG. 4 is a block diagram illustrating the operation of a foldable power plug assembly, according to at least some embodiments.

FIG. 4 is a block diagram illustrating the operation of foldable power plug assembly 200, according to at least some embodiments. More specifically, the block diagram in FIG. 4 represents a side view of foldable power plug assembly 200 illustrating the operation of one of the two levers 240 of the lever-based mechanism illustrated in FIG. 3 when foldable power plug assembly 200 transitions between a fully deployed state and a fully retracted state from the perspective of ground pin 220 and one of the power pins 215. The operation of the second lever 240 shown in FIG. 3 is symmetrical from the perspective of ground pin 220 and the other one of the power pins 215.

As shown in FIG. 4, within the lever-based mechanism, ground pin 220 and power pin 215 are connected via lever 240, which includes two separate slots (shown as slot 242 and slot 246). More specifically, ground pin 220 includes (or is coupled to) a first post 264 proximate the bottom end of ground pin 220 and power pin 215 includes (or is coupled to) a second post 262 proximate the bottom end of power pin 215. When foldable power plug assembly 200 is in a fully deployed state, as shown in FIG. 4, the first post 264 is positioned at the end of slot 246 nearest to pivot point 248 of lever 240 and the second post 262 is positioned at the opposite end of slot 242 (e.g., the end of slot 242 farthest away from pivot point 248). When foldable power plug assembly 200 is in the fully deployed state, ground pin 220 extends through a first opening in the top surface 212 of the base portion 210 (such as opening 230 illustrated in FIG. 2) in a direction substantially perpendicular to top surface 212 to its a fully deployed position and power pin 215 extends through a second opening in the top surface 212 of the base portion 210 in a direction substantially perpendicular to top surface 212 to its a fully deployed position. In the illustrated example, when foldable power plug assembly 200 is in the fully deployed state, ground pin 220 extends into base portion 210 such that its bottom edge, and post 264, are further below top surface 212 than the bottom edge of power pin 215 (and post 262), and the depth below top surface 212 of an axis 244 about which ground pin 220 rotates when transitioning between the fully deployed state and a partially deployed state or the fully retracted state is between the depths of post 264 and 262.

In the illustrated embodiment, when a force 256 is applied to ground pin 220 in the direction shown in FIG. 4, ground pin 220 moves in the folding direction (shown as rotational direction 252) toward its fully retracted position within opening 230 (not shown in FIG. 4). This movement causes post 264 to slide diagonally along slot 246 toward the opposite end of slot 246 (i.e., toward the end of slot 246 farthest away from pivot point 248). The linear movement of post 264 within slot 246 creates a rotational movement on lever 240 about pivot point 248. This rotational movement is, in turn, converted by the pivoting of lever 240 into a linear force on post 262 in a downward direction (shown as direction 254) causing power pin 215 to be retracted toward its fully retracted position within base portion 210 (not shown in FIG. 4).

Similarly, when a force is applied to ground pin 220 in a folding direction for ground pin 220 while the foldable power plug assembly is in a partially deployed position, foldable power plug assembly 200 (or a lever-based mechanism thereof) may be configured to retract both ground pin 220 and power pin 215 toward their respective fully retracted positions.

Figure 5A:
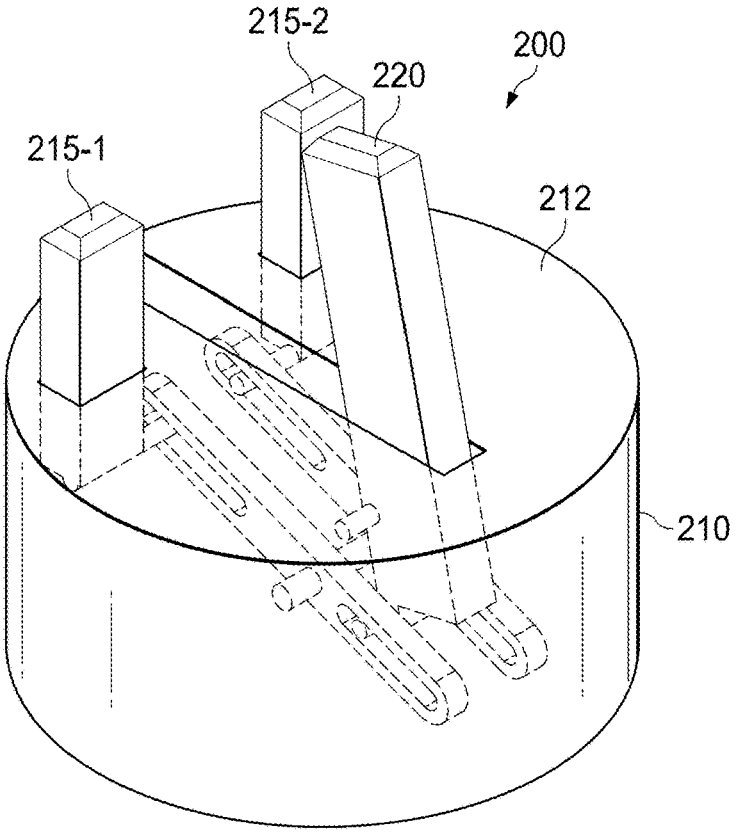
FIGS. 5A-5C illustrate perspective views of a foldable power plug assembly, including selected internal elements, in different states of partial deployment, respectively, according to at least some embodiments.
Figure 5B:
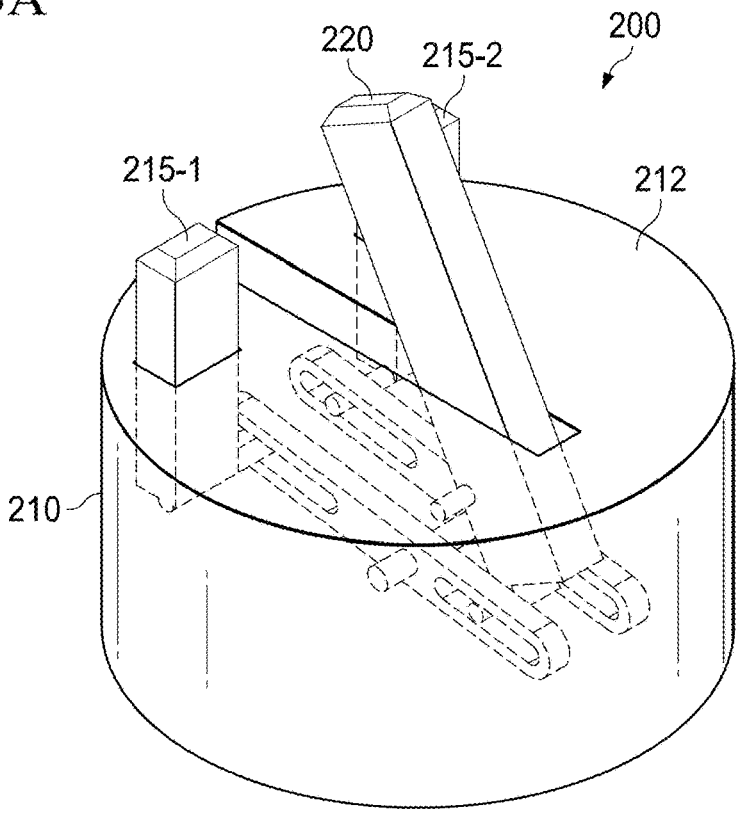
Figure 5C:
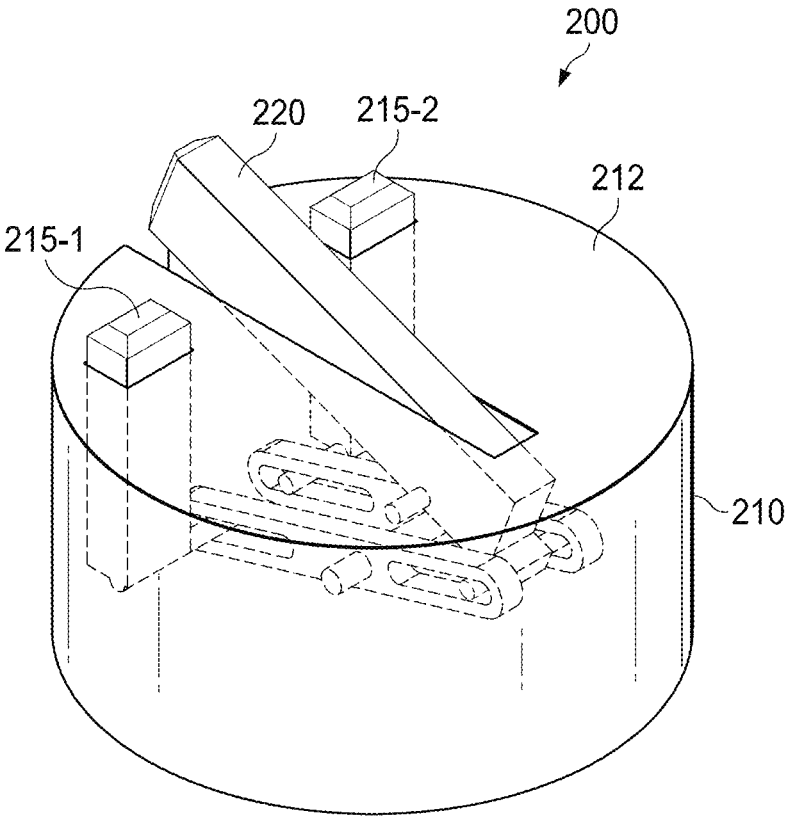

FIGS. 5A-5C illustrate perspective views of foldable power plug assembly 200, including selected internal elements, in different states of partial deployment, respectively, according to at least some embodiments. For example, FIGS. 5A-5C illustrate foldable power plug assembly 200 at different points in time as it transitions between a fully deployed state and a fully retracted state through three intermediate partially deployed states. As illustrated in this example, when ground pin 220 is retracted into base portion 210, it is folded down into an opening in the top surface 212 (such as opening 230 illustrated in FIG. 2), eventually coming to rest in a position substantially parallel to top surface 212. However, when power pins 215 are retracted into base portion 210, they remain vertical (e.g., substantially perpendicular to top surface 212), eventually coming to rest in a vertical position below top surface 212.

In each successive one of the partially deployed states shown in FIGS. 5A-5C, ground pin 220 is shown positioned at a shallower angle with respect to top surface 212 and power pin 215 is shown retracted deeper within base portion 210. For example, the angle between ground pin 220 and top surface 212 (in the folding direction) shown in FIG. 5B is less than the angle between ground pin 220 and top surface 212 shown in FIG. 5A. Similarly, the angle between ground pin 220 and top surface 212 shown in FIG. 5C is less than the angle between ground pin 220 and top surface 212 shown in FIG. 5B. In addition, the amount by which power pins 215-1 and 215-2 extend above top surface 212 as shown in FIG. 5B is less than the amount by which power pins 215-1 and 215-2 extend above top surface 212 as shown in FIG. 5A. Similarly, the amount by which power pins 215-1 and 215-2 extend above top surface 212 as shown in FIG. 5C is less than the amount by which power pins 215-1 and 215-2 extend above top surface 212 as shown in FIG. 5B.

Figure 6:
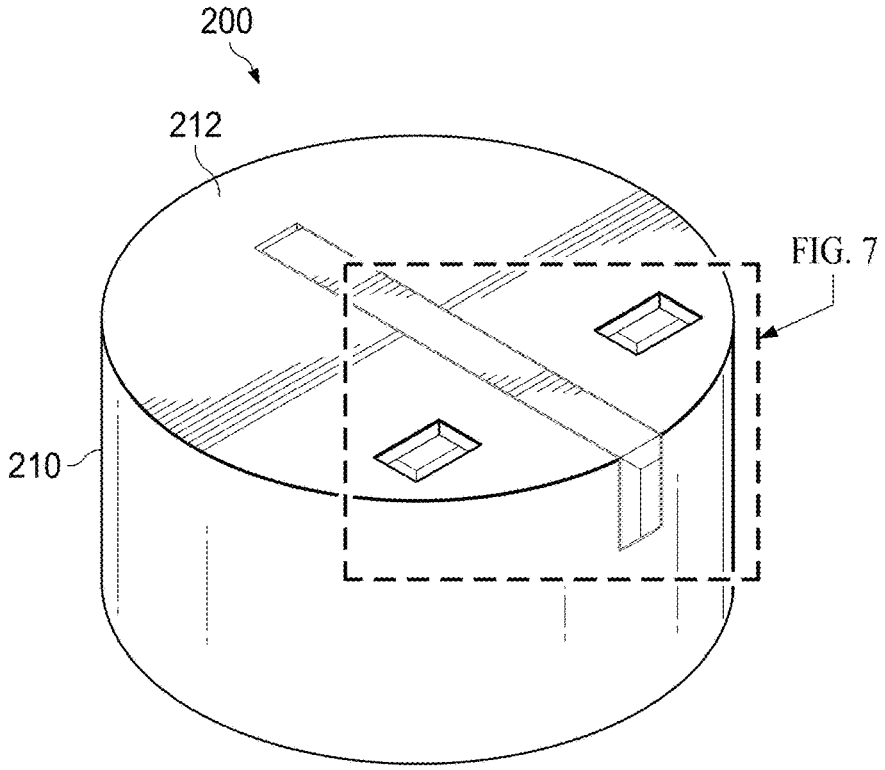
FIG. 6 illustrates a perspective view of selected elements of a foldable power plug assembly in a fully retracted state, according to at least some embodiments.
Figure 7:
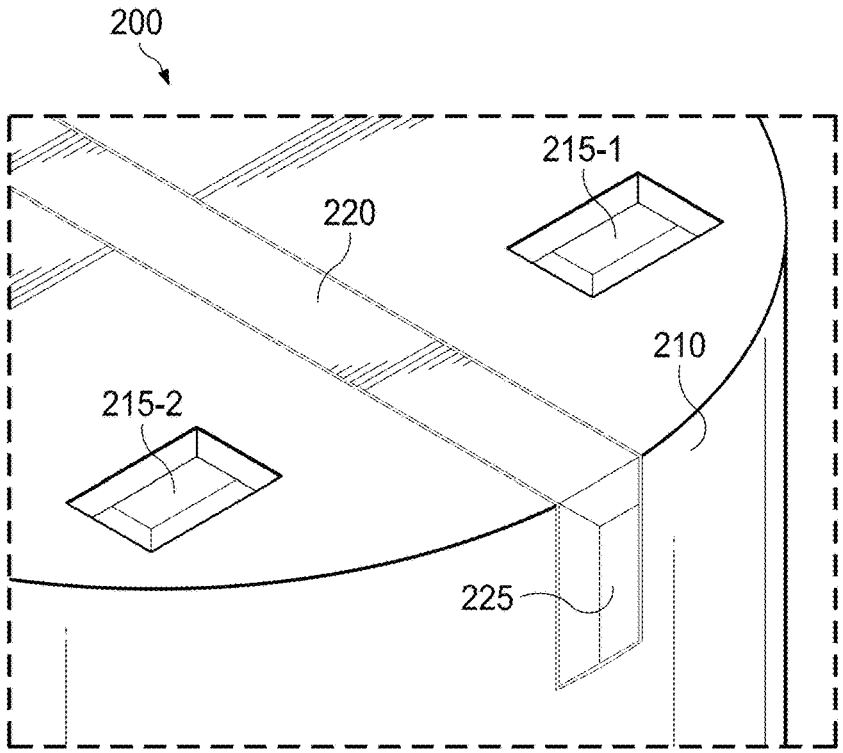
FIG. 7 illustrates an expanded view of a portion of the foldable power plug assembly shown in FIG. 6, according to at least some embodiments.

FIG. 6 illustrates a perspective view of selected elements of foldable power plug assembly 200 in a fully retracted state and FIG. 7 illustrates an expanded view of a portion of the foldable power plug assembly shown in FIG. 6, according to at least some embodiments. As illustrated in these figures, when foldable plug assembly 200 is in the fully retracted state, ground pin 220 is retracted into its fully retracted position within base portion 210 such that ground pin 220 is substantially parallel to top surface 212 within an opening (such as opening 230 illustrated in FIG. 3) on top surface 212 and no part of ground pin 220 extends through the opening in top surface 212. In the illustrated example, the opening extends from one edge of top surface 212 to an interior point on top surface 212 and encompasses an opening on the side of base portion 210 at the intersection of top surface 212 and the side of base portion 210. In the illustrated embodiment, at least a small portion of the tip 225 of ground pin 220 may extend through this opening on the side of base portion 210, allowing a user to easily grip tip 225 to lift ground pin 220 and extract ground pin 220 from base portion 210. In other embodiments, no portion of the tip 225 of ground pin 220 extends through this opening on the side of base portion 210, but the shape of tip 225 is such that a user can grip tip 225 in order to lift ground pin 220 and extract ground pin 220 from base portion 210.

As illustrated in FIGS. 6 and 7, when foldable plug assembly 200 is in the fully retracted state, power pins 215-1 and 215-2 are retracted into the base portion 210 such that they are substantially perpendicular to top surface 212 and no part of power pin 215-1 or 215-2 extends through their respective openings in top surface 212.

Figure 8:
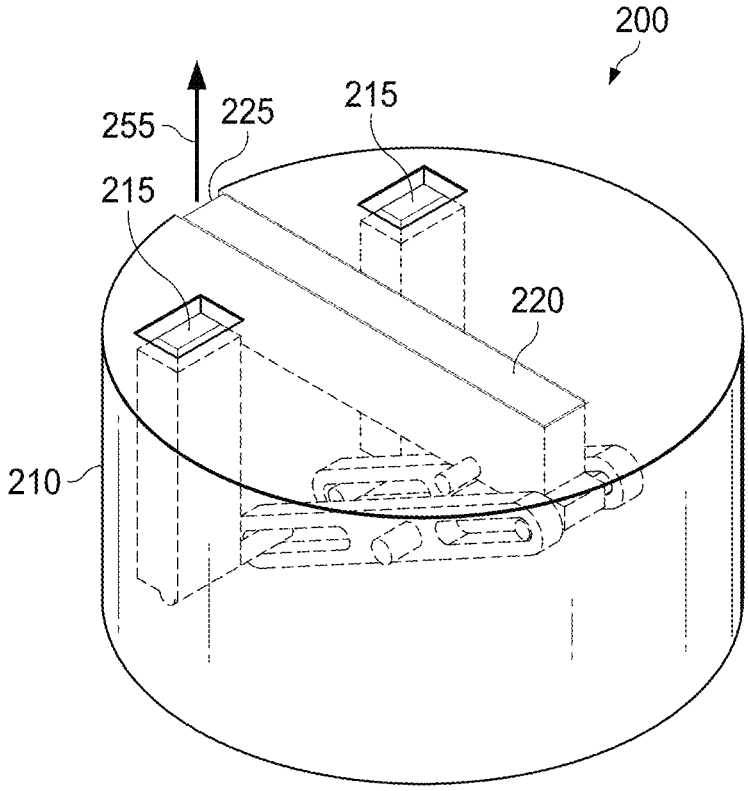
FIG. 8 illustrates a perspective view of a foldable power plug assembly in a fully retracted state, including selected internal elements, according to at least some embodiments.

FIG. 8 illustrates a perspective view of foldable power plug assembly 200 in a fully retracted state, including selected internal elements, according to at least some embodiments. While not fully visible in FIG. 8, when foldable power plug assembly 200 is in the fully retracted state, the first post 264 coupled to ground pin 220 (as illustrated in FIG. 4) is positioned at the end of a respective slot 246 in each of two levers 240 farthest away from a respective pivot point 248 and a respective second post 262 coupled to each of the power pins 215 is positioned at the end of a slot 262 of a respective lever 240 nearest its pivot point 248.

When foldable power plug assembly 200 is in a fully retracted state, to unfold the power plug pins of foldable power plug assembly 200 into their fully deployed positions, the operations described above with reference to FIG. 4 may be reversed. For example, when a force is applied to ground pin 220 to lift and extract ground pin 220 from its fully retracted position within the opening on top surface 212 of base portion 210, ground pin 220 moves in the unfolding direction (i.e., the direction opposite rotational direction 252 shown in FIG. 4) toward its fully deployed position (not shown in FIG. 8). This movement causes post 264 to slide diagonally along slot 246 toward the end of slot 246 nearest pivot point 248. The linear movement of post 264 within slot 246 creates a rotational movement on lever 240 about pivot point 248. This rotational movement is, in turn, converted by the pivoting of lever 240 into a linear force on post 262 in an upward direction (i.e., the direction opposite direction 254 shown in FIG. 4), causing power pins 215 to be extracted from their fully retracted positions within base portion 210 (not shown in FIG. 8).

Similarly, when a force is applied to ground pin 220 in an unfolding direction for ground pin 220 while the foldable power plug assembly is in a partially deployed position, foldable power plug assembly 200 (or a lever-based mechanism thereof) may be configured to unfold both ground pin 220 and power pin 215 toward their respective fully deployed positions.

The lever-based mechanisms for folding and unfolding the power plug pins of a foldable power plug assembly described herein have been demonstrated through the creation of a prototype foldable power plug assembly for a Type-G power plug. These lever-based mechanisms for folding and unfolding the power plug pins of a foldable power plug assembly may, in other embodiments, be applied to power plugs of different types including, but not limited to, power plugs of other three-pin power plug types (e.g., Type-B, Type-I, Type-D, Type-K, Type-F, and/or Type-O). While FIGS. 2-8 illustrate embodiments of a foldable power plug assembly having a particular shape and a particular number and arrangement of pins with particular pin shapes, in other embodiments, the lever-based mechanisms described herein may be applied for folding and unfolding the power plug pins of power plugs of other types, including power plugs of different shapes or sizes and power plugs having any numbers and type of pins of various shapes and sizes.

The foldable power plug assemblies described herein may be implemented as connectors integrated with various power supply units, power adapter accessories, and/or power cables, in some embodiments. In other embodiments, the foldable power plug assemblies described herein may be implemented as stand-alone accessories, such as power plug adapters or power plug converters usable to interface a power supply unit, power adapter accessory, or power cable designed for operation in a given region to an AC power source in a different region.

In some embodiments, rather than including multiple levers for coupling respective power pins to a single ground pin, a foldable power plug assembly may include a single lever configured for connecting a first power plug pin (e.g., a ground pin) to two other power plug pins (e.g., two power pins). For example, a post of a first power pin may be inserted in (or through) a slot in the single lever and a post of a second power pin may be coupled to the post of the first power pin in a fixed position with respect to the post of a first power pin. In this example, the position of the second power pin may be controlled by the single lever and may mirror the position of the first power pin regardless of whether the foldable power plug assembly is in a fully deployed state, one of multiple partially deployed states, or a fully retracted state.

In some embodiments, rather than including slots into which (or through which) posts coupled to various power plug pins can be inserted, each lever of a lever-based mechanism of the foldable power plug assembly may include grooves or another type of track into which respective posts coupled to the power plug pins can be inserted and along which the inserted posts are slidable for retracting the power plug pins into a base portion of the assembly and subsequently extracting the power plug pins from the base portion of the assembly and extending them to their fully deployed positions.

Figure 9:
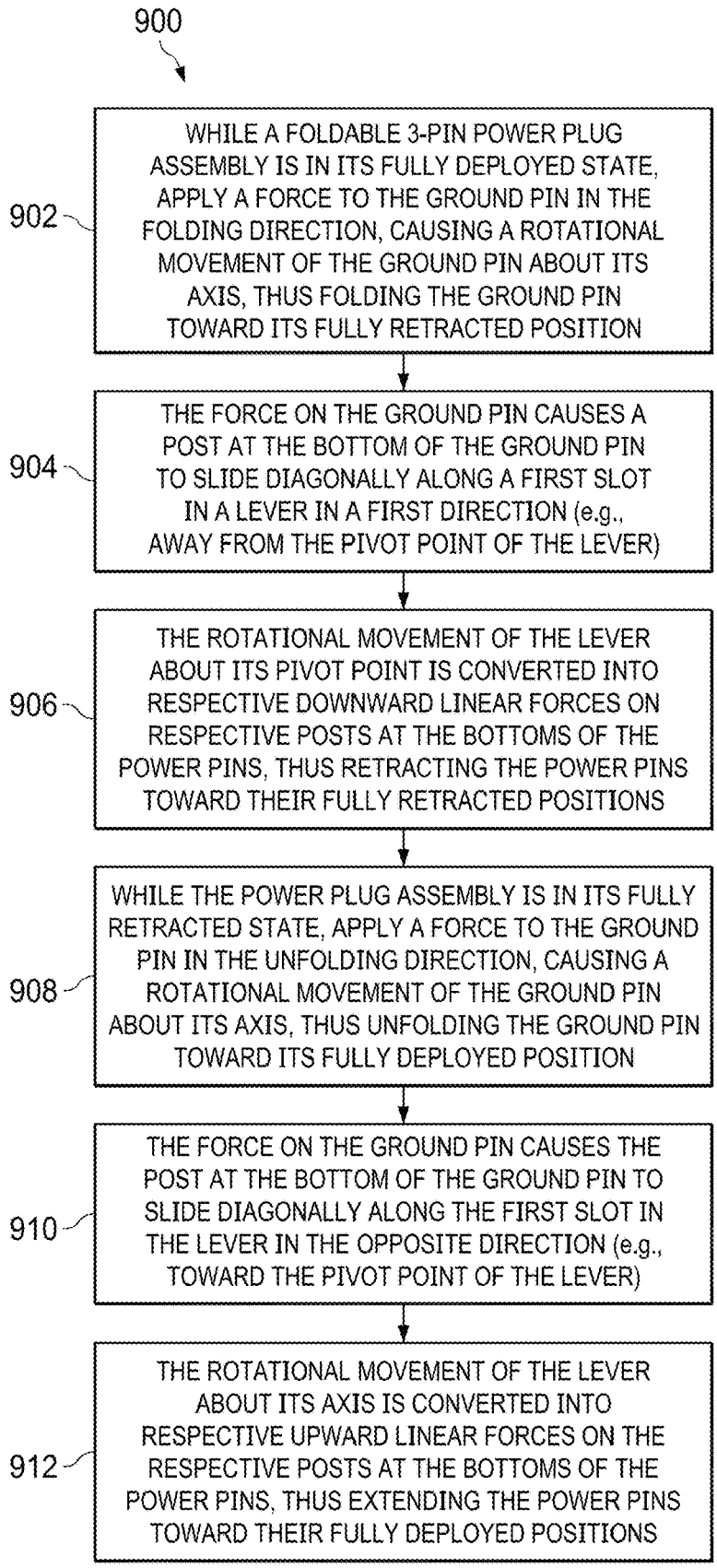
FIG. 9 is a flow diagram illustrating selected elements of a method for operating a foldable power plug assembly, according to at least some embodiments.

FIG. 9 is a flow diagram illustrating selected elements of a method 900 for operating a foldable power plug assembly, such as foldable power plug assembly 200 illustrated in FIGS. 2-8, according to at least some embodiments. In various embodiments, the foldable power plug assembly may be, or may be coupled to, an element of an accessory of an information handling system, such as a power adapter, a power cable, or a power plug adapter. In some embodiments, certain operations of method 900 may be performed by a user using simple and intuitive single-handed movements to initiate the folding and unfolding of the power plug pins of the foldable power plug assembly. Method 900 may be repeated, in whole or in part, one or more times to transition the foldable power plug assembly between various pair of states including a fully deployed state, any of one or more partially deployed states, and a fully retracted state. It is noted that certain operations described in method 900 may be optional or may be rearranged in different embodiments.

In FIG. 9, method 900 may begin (at 902) with, while a foldable three-pin power plug assembly is in its fully deployed state, applying a force to the ground pin in the folding direction, causing a rotational movement of the ground pin about its axis, thus folding the ground pin toward its fully retracted position.

At 904, the method may include the force on the ground pin causing a post at the bottom of the ground pin to slide diagonally along a first slot in a lever in a first direction away from the pivot point of the lever, as described herein.

At 906, method 900 may include converting, by the pivoting, the rotational movement of the lever about its pivot point into respective downward linear forces on respective posts at the bottoms of the power pins, thus retracting the power pins toward their fully retracted positions, as described herein.

At 908, the method may include, while the foldable three-pin power plug assembly is in its fully retracted state, applying a force to the ground pin in the unfolding direction, causing a rotational movement of the ground pin about its axis, thus unfolding the ground pin toward its fully deployed position.

At 910, method 900 may include the force on the ground pin causing the post at the bottom of the ground pin to slide diagonally along the first slot in the lever in the opposite direction (e.g., toward the pivot point of the lever), as described herein.

At 912, the method may include converting, by the pivoting, the rotational movement of the lever about its axis into respective upward linear forces on the respective posts at the bottoms of the power pins, thus extending the power pins toward their fully deployed positions, as described herein.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. An information handling system, comprising:

a power supply unit;

a power cable coupled to the power supply unit through a connector at a first end of the power cable; and a foldable power plug assembly coupled to a second end of the power cable to connect the power cable to an alternating current (AC) power source, the foldable power plug assembly comprising:

a base housing portion;

a first pin including a first post proximate a bottom end of the first pin;

a second pin including a second post proximate a bottom end of the second pin; and a first lever disposed within the base housing portion, the first lever comprising:

a first slot into which the first post is inserted and along which the first post is slidable; and a second slot into which the second post is inserted and along which the second post is slidable;

wherein when the foldable power plug assembly is in a fully deployed state:

the first post is positioned at a first end of the first slot, the first end of the first slot being nearer a pivot point of the first lever than a second end of the first slot;

the second post is positioned at a first end of the second slot, the first end of the second slot being farther from the pivot point of the first lever than a second end of the second slot;

the first pin is positioned in a fully deployed position for the first pin in which the first pin extends through a first opening in a top surface of the base housing portion in a direction substantially perpendicular to the top surface; and the second pin is positioned in a fully deployed position for the second pin in which the second pin extends through a second opening in the top surface of the base housing portion in a direction substantially perpendicular to the top surface; and wherein when the foldable power plug assembly is in a fully retracted state:

the first post is positioned at the second end of the first slot;

the second post is positioned at the second end of the second slot;

the first pin is retracted into a fully retracted position for the first pin in the base housing portion in which the first pin is substantially parallel to the top surface and no part of the first pin extends through the first opening in the top surface; and the second pin is retracted into a fully retracted position for the second pin in the base housing portion in which the second pin is substantially perpendicular to the top surface and no part of the second pin extends through the second opening in the top surface.

2. The information handling system of claim 1, wherein the first pin is a ground pin and the second pin is a power pin.

3. The information handling system of claim 1, wherein the foldable power plug assembly further comprises:

a third pin including a third post proximate a bottom end of the third pin; and a second lever disposed within the base housing portion, the second lever comprising:

a third slot into which the third post of the third pin is inserted and along which the third post is slidable; and a fourth slot into which a fourth post of the first pin is inserted and along which the fourth post is slidable;

wherein when the foldable power plug assembly is in the fully deployed state:

the fourth post is positioned at a first end of the fourth slot, the first end of the fourth slot being nearer a pivot point of the second lever than a second end of the fourth slot;

the third post is positioned at a first end of the third slot, the first end of the third slot being farther from the pivot point of the second lever than a second end of the third slot; and the third pin is positioned in a fully deployed position for the third pin in which the third pin extends through a third opening in the top surface of the base housing portion in a direction substantially perpendicular to the top surface; and wherein when the foldable power plug assembly is in the fully retracted state:

the third post is positioned at the second end of the third slot;

the fourth post is positioned at the second end of the fourth slot; and the third pin is retracted into a fully retracted position for the third pin in the base housing portion in which the third pin is substantially perpendicular to the top surface and no part of the third pin extends through the third opening in the top surface.

4. The information handling system of claim 3, wherein:

the second pin is positioned on a first side of the first opening and the third pin is positioned on a second side of the first opening opposite the first side; and the second pin and the third pin are equidistant from the first pin and are symmetric about the first opening.

5. The information handling system of claim 1, wherein the foldable power plug assembly further comprises:

a third pin including a third post proximate a bottom end of the third pin, the third post coupled to the second post in a fixed position with respect to the second post; and wherein when the foldable power plug assembly is in the fully deployed state:

the third post is positioned proximate the first end of the first slot; and the third pin is positioned in a fully deployed position for the third pin in which the third pin extends through a third opening in the top surface of the base housing portion in a direction substantially perpendicular to the top surface; and wherein when the foldable power plug assembly is in a fully retracted state:

the third post is positioned proximate the second end of the first slot; and the third pin is retracted into a fully retracted position for the third pin in the base housing portion in which the third pin is substantially perpendicular to the top surface and no part of the third pin extends through the third opening in the top surface.

6. The information handling system of claim 1, wherein when the foldable power plug assembly is in the fully deployed state:

the first post is positioned at a depth below the top surface greater than the depth at which the second post is positioned; and the pivot point of the first lever is positioned at a depth below the top surface between the depth at which the first post is positioned and the depth at which the second post is positioned.

7. The information handling system of claim 1, wherein when the foldable power plug assembly is in a partially deployed state:

the first post is positioned between the first end of the first slot and the second end of the first slot;

the second post is positioned between the first end of the second slot and the second end of the second slot;

the first pin is positioned in a partially deployed position for the first pin in which the first pin extends through the first opening in the top surface of the base housing portion at an angle with respect to the top surface of less than ninety degrees; and the second pin is positioned in a partially deployed position for the second pin in which a smaller portion of the second pin extends through the second opening in the top surface of the base housing portion in a direction substantially perpendicular to the top surface than the portion of the second pin that extends through the second opening when the foldable power plug assembly is in the fully deployed state.

8. The information handling system of claim 1, wherein:

responsive to a force applied to the first pin in a folding direction for the first pin while the foldable power plug assembly is in the fully deployed state or in a partially deployed state, the foldable power plug assembly is configured to retract the second pin toward the fully retracted position for the second pin; and responsive to a force applied to the first pin in an unfolding direction for the first pin while the foldable power plug assembly is in the fully retracted state or in a partially deployed state, the foldable power plug assembly is configured to extend the second pin toward the fully deployed position for the second pin.

9. The information handling system of claim 8, wherein:

to retract the second pin toward the fully retracted position for the second pin, the first lever is configured to convert a rotational movement of the first pin in response to the force applied to the first pin in the folding direction into a downward linear force on the second post; and to extend the second pin toward the fully deployed position for the second pin, the first lever is configured to convert a rotational movement of the first pin in response to the force applied to the first pin in the unfolding direction into an upward linear force on the second post.

10. The information handling system of claim 1, wherein the first opening is parallel to the first lever and extends from one edge of the top surface to an interior point on the top surface.

11. A foldable power plug assembly, comprising:

a base housing portion;

a first pin including a first post proximate a bottom end of the first pin;

a second pin including a second post proximate a bottom end of the second pin; and a first lever disposed within the base housing portion, the first lever comprising:

a first slot into which the first post is inserted and along which the first post is slidable; and a second slot into which the second post is inserted and along which the second post is slidable;

wherein when the foldable power plug assembly is in a fully deployed state:

the first post is positioned at a first end of the first slot, the first end of the first slot being nearer a pivot point of the first lever than a second end of the first slot;

the second post is positioned at a first end of the second slot, the first end of the second slot being farther from the pivot point of the first lever than a second end of the second slot;

the first pin is positioned in a fully deployed position for the first pin in which the first pin extends through a first opening in a top surface of the base housing portion in a direction substantially perpendicular to the top surface; and the second pin is positioned in a fully deployed position for the second pin in which the second pin extends through a second opening in the top surface of the base housing portion in a direction substantially perpendicular to the top surface; and wherein when the foldable power plug assembly is in a fully retracted state:

the first post is positioned at the second end of the first slot;

the second post is positioned at the second end of the second slot;

the first pin is retracted into a fully retracted position for the first pin in the base housing portion in which the first pin is substantially parallel to the top surface and no part of the first pin extends through the first opening in the top surface; and the second pin is retracted into a fully retracted position for the second pin in the base housing portion in which the second pin is substantially perpendicular to the top surface and no part of the second pin extends through the second opening in the top surface.

12. The foldable power plug assembly of claim 11, wherein the first pin is a ground pin and the second pin is a power pin.

13. The foldable power plug assembly of claim 11, further comprising:

a third pin including a third post proximate a bottom end of the third pin; and a second lever disposed within the base housing portion, the second lever comprising:

a third slot into which the third post of the third pin is inserted and along which the third post is slidable; and a fourth slot into which a fourth post of the first pin is inserted and along which the fourth post is slidable;

wherein when the foldable power plug assembly is in the fully deployed state:

the fourth post is positioned at a first end of the fourth slot, the first end of the fourth slot being nearer a pivot point of the second lever than a second end of the fourth slot;

the third post is positioned at a first end of the third slot, the first end of the third slot being farther from the pivot point of the second lever than a second end of the third slot; and the third pin is positioned in a fully deployed position for the third pin in which the third pin extends through a third opening in the top surface of the base housing portion in a direction substantially perpendicular to the top surface; and wherein when the foldable power plug assembly is in the fully retracted state:

the third post is positioned at the second end of the third slot;

the fourth post is positioned at the second end of the fourth slot; and the third pin is retracted into a fully retracted position for the third pin in the base housing portion in which the third pin is substantially perpendicular to the top surface and no part of the third pin extends through the third opening in the top surface.

14. The foldable power plug assembly of claim 13, wherein:

the second pin is positioned on a first side of the first opening and the third pin is positioned on a second side of the first opening opposite the first side; and the second pin and the third pin are equidistant from the first pin and are symmetric about the first opening.

15. The foldable power plug assembly of claim 11, further comprising:

a third pin including a third post proximate a bottom end of the third pin, the third post coupled to the second post in a fixed position with respect to the second post;

wherein when the foldable power plug assembly is in the fully deployed state:

the third post is positioned proximate the first end of the first slot; and the third pin is positioned in a fully deployed position for the third pin in which the third pin extends through a third opening in the top surface of the base housing portion in a direction substantially perpendicular to the top surface; and wherein when the foldable power plug assembly is in a fully retracted state:

the third post is positioned proximate the second end of the first slot; and the third pin is retracted into a fully retracted position for the third pin in the base housing portion in which the third pin is substantially perpendicular to the top surface and no part of the third pin extends through the third opening in the top surface.

16. The foldable power plug assembly of claim 11, wherein when the foldable power plug assembly is in the fully deployed state:

the first post is positioned at a depth below the top surface greater than the depth at which the second post is positioned; and the pivot point of the first lever is positioned at a depth below the top surface between the depth at which the first post is positioned and the depth at which the second post is positioned.

17. The foldable power plug assembly of claim 11, wherein when the foldable power plug assembly is in a partially deployed state:

the first post is positioned between the first end of the first slot and the second end of the first slot;

the second post is positioned between the first end of the second slot and the second end of the second slot;

the first pin is positioned in a partially deployed position for the first pin in which the first pin extends through the first opening in the top surface of the base housing portion at an angle with respect to the top surface of less than ninety degrees; and the second pin is positioned in a partially deployed position for the second pin in which a smaller portion of the second pin extends through the second opening in the top surface of the base housing portion in a direction substantially perpendicular to the top surface than the portion of the second pin that extends through the second opening when the foldable power plug assembly is in the fully deployed state.

18. The foldable power plug assembly of claim 11, wherein:

responsive to a force applied to the first pin in a folding direction for the first pin while the foldable power plug assembly is in the fully deployed state or in a partially deployed state, the foldable power plug assembly is configured to retract the second pin toward the fully retracted position for the second pin; and responsive to a force applied to the first pin in an unfolding direction for the first pin while the foldable power plug assembly is in the fully retracted state or in a partially deployed state, the foldable power plug assembly is configured to extend the second pin toward the fully deployed position for the second pin.

19. The foldable power plug assembly of claim 18, wherein:

to retract the second pin toward the fully retracted position for the second pin, the first lever is configured to convert a rotational movement of the first pin in response to the force applied to the first pin in the folding direction into a downward linear force on the second post; and to extend the second pin toward the fully deployed position for the second pin, the first lever is configured to convert a rotational movement of the first pin in response to the force applied to the first pin in the unfolding direction into an upward linear force on the second post.

20. The foldable power plug assembly of claim 11, wherein the first opening is parallel to the first lever and extends from one edge of the top surface to an interior point on the top surface.

* * * * *